US006328496B1

(12) United States Patent
Hill et al.

(10) Patent No.: US 6,328,496 B1
(45) Date of Patent: Dec. 11, 2001

(54) MARKING INSTRUMENTS

(75) Inventors: Alan Robert Hill, Cambridge, MA (US); Clive Barnes, Cumnor (GB); Charles Christopher Packham, Crowthorne (GB); Mark Arthur Seddon, Reading (GB)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 09/819,037

(22) Filed: Mar. 8, 2001

Related U.S. Application Data

(63) Continuation of application No. 09/325,762, filed on Jan. 7, 1999, now abandoned, which is a continuation of application No. 09/096,817, filed on Jun. 12, 1998, now abandoned, which is a continuation of application No. PCT/US96/19883, filed on Dec. 12, 1996.

(30) Foreign Application Priority Data

Dec. 15, 1995 (GB) ..... 9525691
Oct. 8, 1996 (GB) ..... 9620986

(51) Int. Cl.[7] ..... B43K 7/00
(52) U.S. Cl. ..... 401/209; 401/216
(58) Field of Search ..... 401/209, 6, 216, 401/212, 214, 240, 251

(56) References Cited

U.S. PATENT DOCUMENTS

| | | | |
|---|---|---|---|
| D. 299,660 | 1/1989 | Gordo | D19/54 |
| D. 302,442 | 7/1989 | Gordo | D19/55 |
| 3,094,105 | 6/1963 | Jenkins | 120/42.16 |
| 3,281,933 | 11/1966 | Fehling et al. | 29/520 |
| 3,352,621 | 11/1967 | Fehling et al. | 401/109 |
| 3,396,569 | 8/1968 | Miller | 72/369 |
| 3,554,660 | 1/1971 | Woods | 401/214 |
| 3,945,735 | 3/1976 | Nakashiki et al. | 401/216 |
| 3,972,630 | 8/1976 | Schenk | 401/217 |
| 4,594,015 | 6/1986 | Pomares | 401/266 |
| 5,012,663 | 5/1991 | Brown | 72/369 |
| 5,172,994 | 12/1992 | Brown | 401/209 |
| 5,527,124 | 6/1996 | Kolaric | 401/6 |

FOREIGN PATENT DOCUMENTS

| | | |
|---|---|---|
| 801 614 | 1/1951 | (DE) . |
| 871 258 | 3/1953 | (DE) . |
| 879 811 | 6/1953 | (DE) . |
| 902 352 | 1/1954 | (DE) . |
| 2 009 062 | 9/1970 | (DE) . |
| 24 52 807 | 5/1976 | (DE) . |
| 1.032.122 | 6/1953 | (FR) . |
| 2.151.240 | 4/1973 | (FR) . |
| 738740 | 10/1955 | (GB) . |
| 877340 | 9/1961 | (GB) . |
| 496361 | 7/1954 | (IT) . |
| 776706 | 1/1979 | (SU) . |
| WO 98/13216 | 4/1998 | (WO) . |

*Primary Examiner*—David J. Walczak
(74) *Attorney, Agent, or Firm*—Marshall, Gerstein & Borun

(57) ABSTRACT

A marking instrument, such as a pen, is disclosed. The marking instrument includes a marking tip carried at the end of a tubular member for conducting marking fluid to the marking tip. The marking tip includes a tubular rear end section of circular cross-section. The tubular member is elliptical in cross-section and is attached to the tubular rear end section of the marking tip at an angle to the longitudinal axis of the tubular member. The elliptical shape of the tubular member allows for a circular profile opening when the tubular member is cut at an angle to join the tubular rear end section of the marking tip. Because the complementary profiles are circular in shape at the connection plane, it is not necessary to rotationally orient the components when bringing them together to be joined. The tubular rear end section of the marking tip may also be elliptical in shape, thereby requiring both the tubular rear end section and the tubular member to be cut at similar angles to produce the circular profile opening.

5 Claims, 5 Drawing Sheets

MARKING INSTRUMENTS

This is a Continuation of U.S. application Ser. No. 09/325,762, filed Jan. 7, 1999 now abandoned, which is a continuation of application Ser. No. 09/096,817, filed Jun. 12, 1998 now abandoned, which is a continuation of PCT/US96/19883, filed Dec. 12, 1996.

This invention relates to the field of marking instruments, especially, but not necessarily exclusively, writing instruments, in which a marking fluid is delivered to a marking tip from a reservoir.

Many writing instruments have marking tips which project axially out of the barrel of the instrument in which the reservoir chamber is housed and by means of which the writing instrument is held in the hand in use. Furthermore, many marking tips, such as ball point pens, have tips which function most effectively if the tip is held substantially perpendicular to the surface being written on, but the majority of writers hold writing instruments inclined at an angle to the paper, typically at about 30° away from perpendicular. It has been proposed to angle the marking tip to the main axis of the writing instrument in order to obtain a better orientation of the tip to the paper, but a satisfactory tip construction suitable for manufacture on a production scale has so far eluded those who have attempted to produce such writing tips.

The present invention provides a simple and economic solution to the above problem and in accordance with the invention there is provided a marking instrument comprising a marking tip carried at the end of a tubular member surrounding a channel for conducting marking fluid to the tip, wherein the tip has a tubular rear end section joined to the tubular member, so that the tip is fixed at an angle to a longitudinal axis of the tubular member, and at a connection plane where the tip and tubular member are joined, the tubular member and tubular section have complementary profiles of substantially the same shape.

Preferably the complementary profiles are circular in shape at the connection plane, which precludes the necessity to rotationally orientate the components when bringing them together to be joined. The tubular member may be tube of constant cross-section. In one preferred construction a tube of elliptical cross-section in used. The tubular section of the tip in preferably circular in cross-section, which simplifies the tip construction, particularly in the case of a ball point tip in which a spherical ball is retained. The tubular member can be made from a hollow component initially formed, such as by deep drawing, with a part-spherical end. Removal of a section of the part spherical end along a plane inclined to the longitudinal axis leaves an edge of circular profile for attachment of the tip. The hollow component may have a substantially cylindrical shape, or can vary in cross-section along its length if desired.

As the point at which the tip engages a surface is offset from the longitudinal axis of the tubular member, in use, forces can be experienced tending to rotate the tubular member. Conveniently rotation of the tubular member is resisted by engaging a non-circular portion of this member, e.g. an end of an elliptical tube or a flange with a non-circular periphery, in a socket of complementary cross-section formed in a body of the instrument. In the case of a ball point pen, for example, the body could be the forward end of the pen barrel, or it could be the body of a refill which is fitted replaceably into the pen barrel.

The tip and tubular member can be fixedly joined by any suitable technique, but laser welding has been found particularly effective and efficient.

A full understanding will be gained from the following detailed description of some preferred embodiments, reference being made to the accompanying drawings in which.

Figure 8:
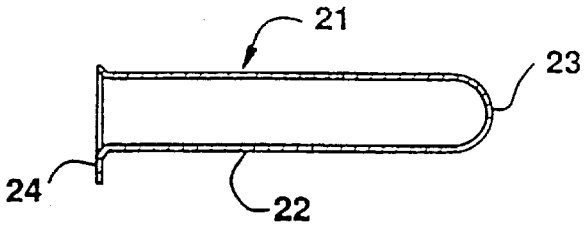
FIG. 8 is an axial section through a deep drawn hollow component, taken on the line 8—8 of FIG. 9, used in the manufacture of a marking tip in accordance with the invention.
Figure 9:
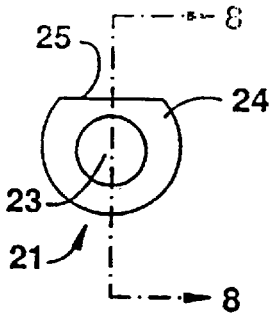
FIG. 9 is a rear end elevation of the component shown in FIG. 8.
Figure 10:
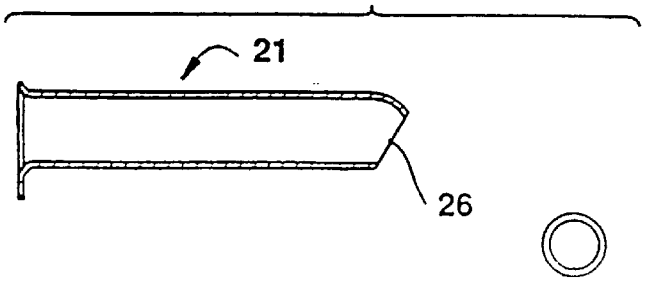
Figure 11:
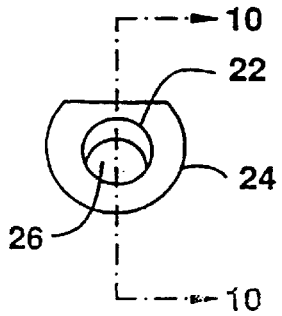

FIGS. 10 and 11 are views corresponding to FIGS. 8 and 9, respectively, showing the hollow component after removal of a section from the closed end thereof, FIG. 10 being an axial cross-section through the hollow component taken on the line 10—10 in FIG. 11.

Figure 12:
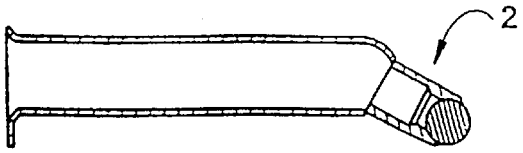
Figure 13:
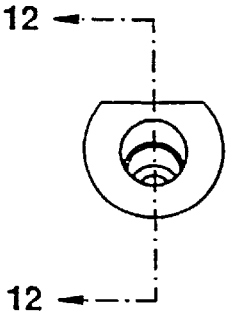

FIGS. 12 and 13 are an axial section and rear elevation, respectively, of a complete marking tip assembly with a ball point tip attached to the hollow component, FIG. 12 being an axial cross-section through the complete marking tip assembly taken on the line 12—12 in FIG. 13.

Figure 14:
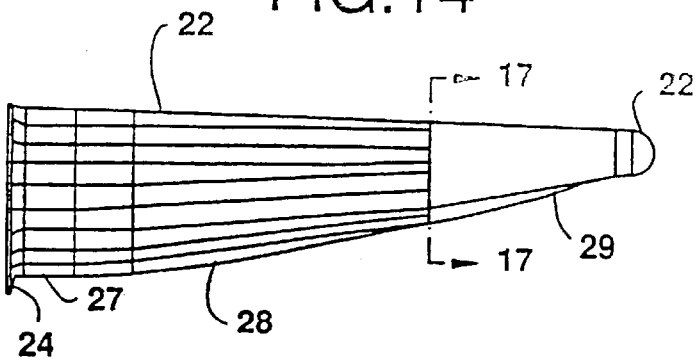
Figure 17:
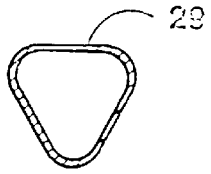
Figure 15:
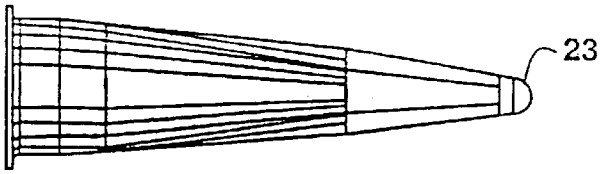
Figure 16:
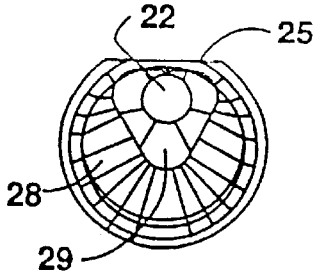
Figure 18:
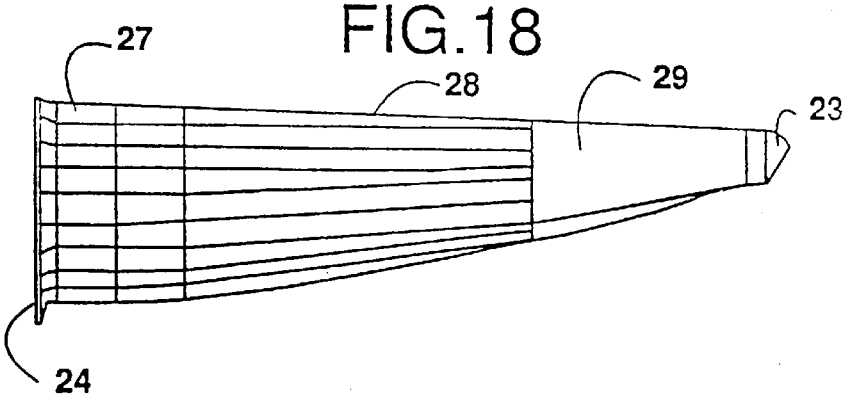
Figure 19:
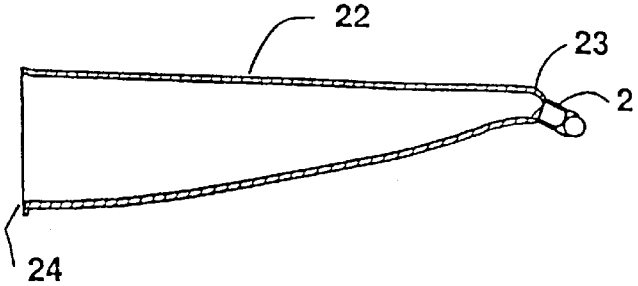
Figure 20:
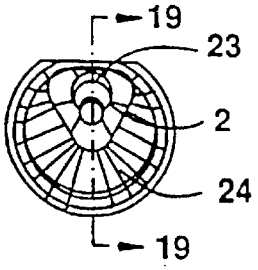
Figure 21:
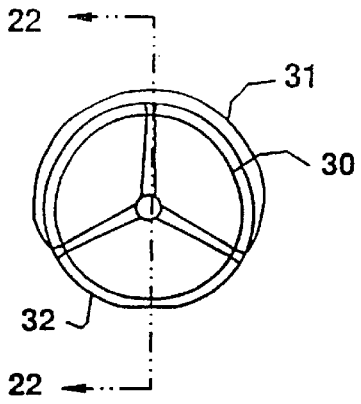
Figure 22:
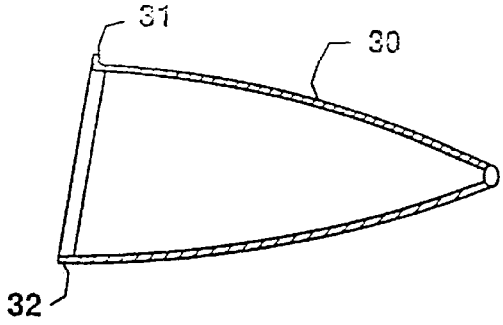
Figure 23:
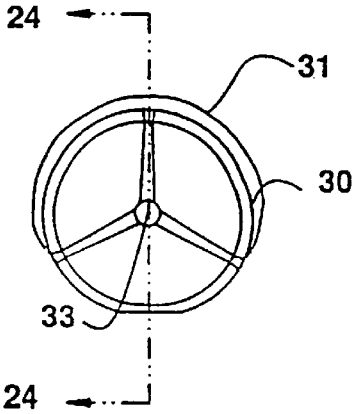
Figure 24:
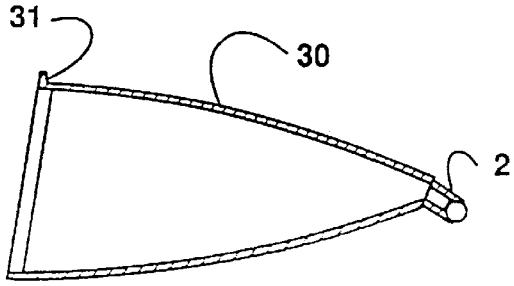
Figure 25:
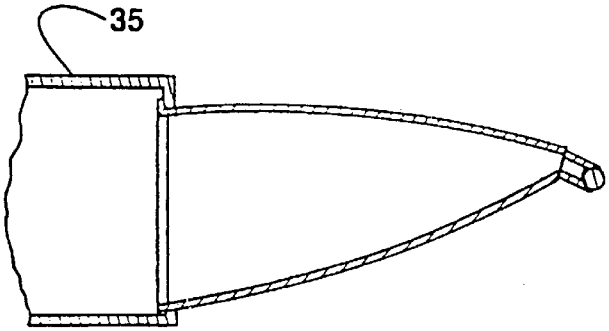

FIG. 14 is a side elevation of an alternative deep drawn hollow component;

FIG. 15 is a plan of the component of FIG. 14;

FIG. 16 is a front elevation of the hollow component;

FIG. 17 is a cross-section taken along the line 17—17 of FIG. 14;

FIG. 18 is a side elevation of the component of FIG. 14 after removal of a section from the closed end thereof;

FIG. 19 is a longitudinal section through the component of FIG. 18, taken along the line 19—19 of FIG. 20, with a ball point tip fixed thereto;

FIG. 20 is a front elevation of the tip assembly of FIG. 19;

FIG. 21 is a front end elevation of another deep drawn component;

FIG. 22 is an axial section taken along the line 22—22 of FIG. 21;

FIG. 23 shows in front elevation the component of FIGS. 21 and 22 after removal of the end section ready for attachment of the ball point tip;

FIG. 24 is an axial section taken along the line 24—24 of FIG. 23, after attachment of the ball point tip; and FIG. 25 shows the finished marking tip assembled with a pen body.

Figure 3:
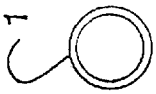
FIG. 3 is a perspective view of the tube component, showing the tube profile at the forward end face.
Figure 2:
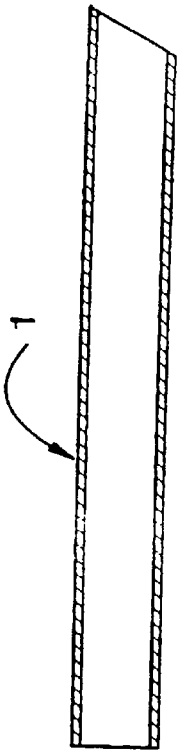
FIG. 2 is an axial section through the tube component taken on the line 2—2 in FIG. 1.
Figure 4:
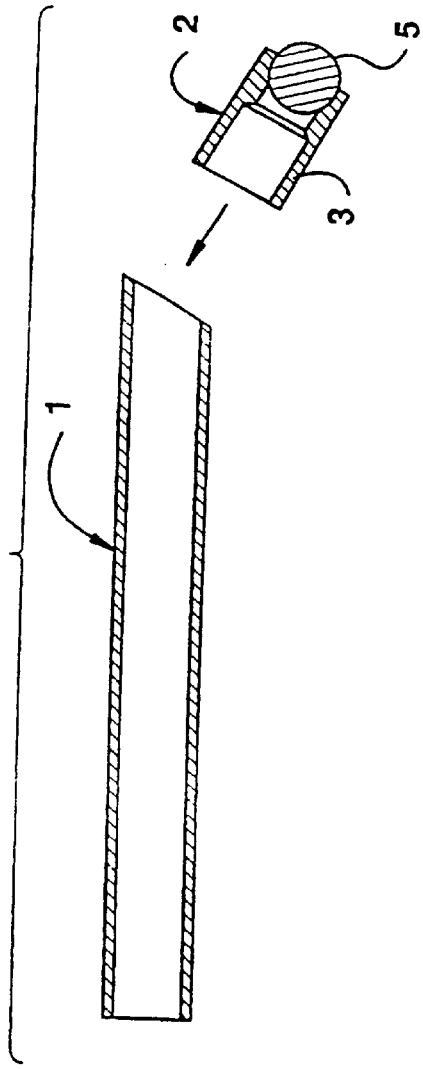
FIG. 4 shows the tube component and a ball point tip being assembled together.
Figure 1:
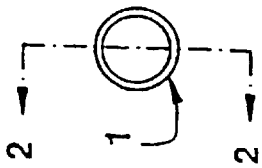
FIG. 1 is a transverse cross-section through a tube component utilised in a marking tip according to the invention.
Figure 6:
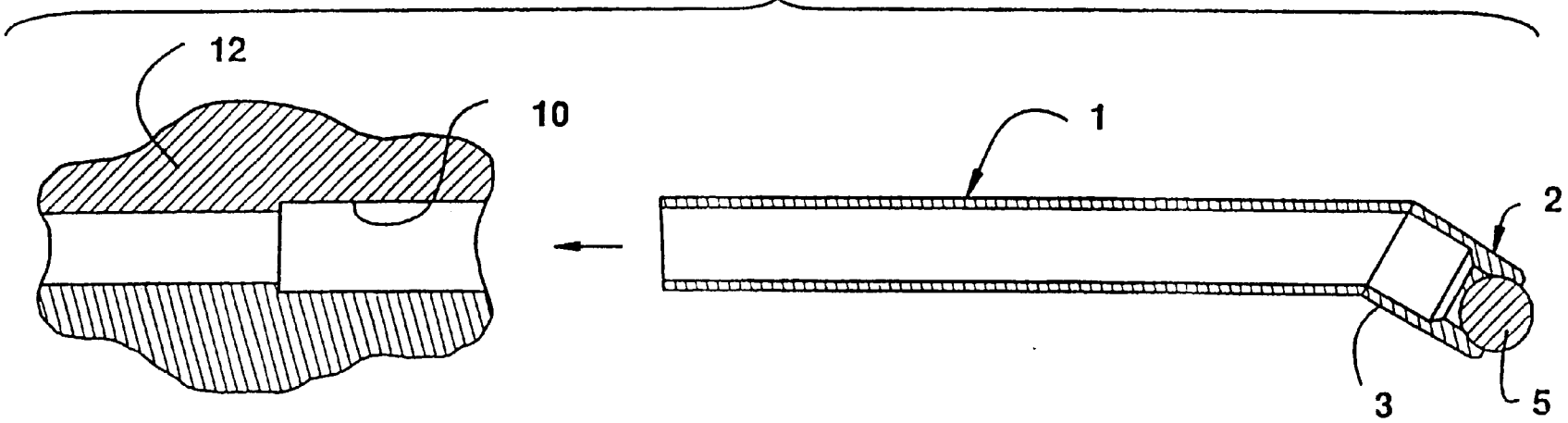
FIG. 6 is an axial cross section through the joined tip and tube and illustrating assembly with a body part.
Figure 5:
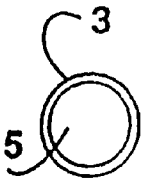
FIG. 5 is a forward end view of the tip.
Figure 7:
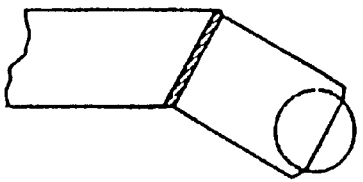
FIG. 7 is a side elevation of the tip and tube joined and welded together.

Illustrated in FIGS. 1–3 is a tubular member of a marking instrument, this member being a tube 1, the transverse cross-section of which is a 30° ellipse. The forward end of this tube is cut so that the end face lies in a plane at 60° to the tube axis and the profile of the end face is circular. The marking tip 2, which is a ball point writing tip as shown in the exemplary embodiment, includes a tubular rear section 3, which is cylindrical and has an end face with a circular profile complementary to that of the end of the tube 1. The complementary circular profiles mean the tube and tip can be easily brought together with their respective end faces in abutment ready for welding, as no rotational alignment is required. The tip and tube are fastened securely together in the assembled condition by laser welding, their abutting end faces defining a connection plane which is angled so that the tip 2 extends at 30° to the axis of the tube. As the point at which the ball 5 of the tip will contact the paper in use of the pen is offset, there is a tendency for the forces exerted on the tip to rotate the tube. To prevent such rotation occurring, the tube is inserted into a socket 10 of complementary elliptical cross-section formed in a body 12. The body can cover the tube over most of its length down to the welded joint with the tip, or it could even extend beyond this joint if required.

It is not essential to use a 30° ellipse for the tube cross-section and other sections can be used if different tip angles are required. For a writing instrument, however, a tip angle in the range of 25° to 35° is likely to be appropriate for most users. Also, there are other ways to bring the end face profiles of the tube and tip to match at the connection plane, e.g. by making the rear end section of the tip elliptical and cutting it at an angle, but this is likely to complicate manufacture of the tip component, especially if it incorporates a spherical ball. Furthermore the tip rear section and tube could both be cylindrical and have their end faces cut at the same angles so that complementary elliptical end faces are obtained, but this would require the components to be accurately rotationally aligned before being welded.

Although the tubular member to which the tip is joined is referred to as a tube, it can include additional features, such as an external flange which could key with the pen body to help resist rotation of the marking tip.

FIGS. 8 to 13 show an alternative embodiment of the invention in which the ball point tip 2 is laser welded to a tubular member in the form of a hollow component 21 initially shaped by deep drawing. As illustrated in FIGS. 8 and 9, the component 21 is deep drawn to include a cylindrical part 22 of circular cross-section closed at the forward end by a part-spherical, in particular substantially hemispherical, end wall 23. An external flange 24 is provided at the open rear end of the component 21, and the flange has a non-circular periphery, due to a flat edge portion 25, for orientation of the component in the forward end of a pen body and for keying the component against rotation relative to the pen body. The deep drawn component 21 has a section of the part-spherical end wall removed, such as by grinding along a plane at 60° to the component axis, as depicted in FIGS. 10 and 11, thereby to form an opening 26 surrounded by a circular edge of diameter substantially equal to that of the tubular-rear section 3 of the tip 2. The rear section of the tip is welded to this circular edge so that the tip 2 is fixed to the component 21 with its axis at 30° to the component axis as shown in FIGS. 13 and 14. It is not essential that the forward end of the deep drawn component is closed and it could be broken through during the deep drawing process, always provided that the end wall which is formed is sufficient to enable it to be ground to form an annular edge to match the rear end of the tubular section 3 of the tip. 2.

By using deep drawing to form an initial hollow component in production of the tubular member, various shapes for that member are possible. FIGS. 14 to 20 for example illustrate an embodiment In which the component is tapered and shaped to replicate the appearance of a conventional fountain pen. The component is shaped in the deep drawing process to have a flat upper surface portion extending along the part 22 of the component between the flanged rear end and the part-spherical wall 23 at the front end. This part includes a short cylindrical section 27 adjacent the flange 24 followed by a tapering section 28 at which the cross-section is essentially circular, and a further tapering section 29 at which the cross-section has the shape of a triangle with rounded vertices. Thus, the taper of the hollow member is asymetrical so that the front end portion of the component has a longitudinal axis offset from that of the rear end, and the flat surface has a smooth transition with the part-spherical end wall. A section of the end wall is ground away in a plane at 60° to the longitudinal axis and a ball point tip 2 is laser welded to the circular edge provided by the grinding process, as described in relation to the embodiment of FIGS. 8 to 13, to provide a writing point of similar shape to a conventional fountain pen but having a ball point tip.

FIGS. 21 to 25 show another embodiment in which a hollow component 30 is formed by deep drawing. To facilitate the deep drawing process the component has a cross-section which reduces gradually along the axis of draw. For purposes which will be explained below the rear end of the component is formed with an external peripheral flange 31 which lies in a plane inclined at an angle of 5 to 10°, e.g. around 8° to a plane perpendicular to the draw axis. The flange includes a flat 32 for rotational orientation purposes. The component 30 is formed at the leading end with a part spherical end wall and as in the previous embodiments a section of this end wall is removed by grinding to define a circular edge 33, in this case in a plane at an angle of about 50° to the longitudinal axis, for attachment of the ball point tip 2 by laser welding. The completed marking tip is assembled in a pen body 35 as illustrated in FIG. 25, with the flange 31 concentric with the axis of the body and in a plane perpendicular to that axis. As a consequence, the axis of the deep drawn tip component 30 is inclined to the longitudinal axis of the pen body and the extreme point of the tip, i.e. the surface of the ball which contacts the paper during writing, is located a positioned space above the axis of the pen body, which has been found to be desirable in a writing instrument with an angled tip. The flat section 32 of the flange 31 keys with the pen body to prevent rotation of the marking tip relative to the pen body. There are, of course, other ways to ensure the angled orientation of the marking tip with respect to the axis of the writing instrument.

With a writing instrument embodying the invention it can be assured that the tip will be substantially perpendicular to the paper when in use. This means the rim of the tip surrounding the ball is more easily kept clear of the paper, and allows a small ball capable of drawing finer lines to be used.

While it is apparent that modifications and changes can be made within the spirit and scope of the present invention, it is our intention, however, only to be limited by the appended claims.

What is claimed is:

1. A marking instrument comprising a marking tip carried at the end of a tubular member surrounding a channel for conducting marking fluid to the tip, the tubular member being elliptical in cross-section, wherein the tip has a tubular rear end section joined to the tubular member so that the tip is fixed at an angle to the longitudinal axis of the tubular member, and at a connection plane where the tip and tubular member are joined, the tubular member and tubular section have complementary, substantially circular profiles.

2. A marking instrument according to claim 1, wherein the profiles are circular in shape at the connection plane.

3. A marking instrument according to claim 1, wherein a portion of the elliptical tube is engaged in a socket of complementary cross-section formed in a body of the instrument.

4. A marking instrument according to claim 1, wherein the tip is fixed to the tubular member by welding.

5. A marking instrument according to claim 1, wherein the tip is a ball point tip.

* * * * *